US011040827B1

(12) United States Patent
Tejeda

(10) Patent No.: US 11,040,827 B1
(45) Date of Patent: Jun. 22, 2021

(54) GARDEN DEBRIS RECEPTACLE WITH DUSTPAN

(71) Applicant: Omar Tejeda, Palmdale, CA (US)

(72) Inventor: Omar Tejeda, Palmdale, CA (US)

( * ) Notice: Subject to any disclaimer, the term of this patent is extended or adjusted under 35 U.S.C. 154(b) by 334 days.

(21) Appl. No.: 16/253,311

(22) Filed: Jan. 22, 2019

(51) Int. Cl.
*B65F 1/02* (2006.01)

(52) U.S. Cl.
CPC ..... *B65F 1/02* (2013.01); *B65F 2240/138* (2013.01)

(58) Field of Classification Search
CPC ..... B65F 1/02; B65F 1/10
USPC ..... 220/735, 729, 600, 908, 659, 657, 656; D34/1
See application file for complete search history.

(56) References Cited

U.S. PATENT DOCUMENTS

| | | | | |
|---|---|---|---|---|
| 3,170,183 | A | 2/1965 | Leatherman | |
| 4,312,531 | A | 1/1982 | Cross | |
| 4,802,258 | A | 2/1989 | Jensen | |
| D351,699 | S | 10/1994 | Temple | |
| D351,705 | S | 10/1994 | Bird | |
| 5,611,450 | A | 3/1997 | DeMars | |
| 6,082,574 | A | 7/2000 | Johnson | |
| 6,318,588 | B1 | 11/2001 | Lichtenwalner | |
| 7,017,773 | B2 * | 3/2006 | Gruber | B65F 1/122 220/669 |
| 8,291,543 | B2 * | 10/2012 | McCoy | A47L 13/52 15/257.1 |
| 8,523,007 | B2 | 9/2013 | Miller | |
| 8,757,453 | B1 * | 6/2014 | Olsson | B65D 25/48 222/570 |
| 9,480,383 | B2 * | 11/2016 | Wollman | B65F 1/10 |
| D802,865 | S * | 11/2017 | Dervin | D34/10 |
| 10,301,109 | B2 * | 5/2019 | Dervin | A47L 13/52 |
| 2003/0111854 | A1 * | 6/2003 | Washek | B65F 1/10 294/180 |
| 2013/0192631 | A1 | 8/2013 | Scoralle | |
| 2018/0042445 | A1 * | 2/2018 | Carcioppolo | B65F 1/10 |
| 2018/0057258 | A1 * | 3/2018 | Dervin | B65F 1/10 |

* cited by examiner

*Primary Examiner* — Robert J Hicks

(57) ABSTRACT

The garden debris receptacle with dustpan comprises a refuse container and a lip extension. The lip extension attaches to the refuse container. The garden debris receptacle with dustpan is configured for use with agricultural refuse. The lip extension forms a ramp that assists in loading the agricultural refuse into the refuse container.

16 Claims, 4 Drawing Sheets

GARDEN DEBRIS RECEPTACLE WITH DUSTPAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of transportation and material storage, more specifically, a refuse receptacle with filling means. (B65F1/10)

SUMMARY OF INVENTION

The garden debris receptacle with dustpan comprises a refuse container and a lip extension. The lip extension attaches to the refuse container. The garden debris receptacle with dustpan is configured for use with agricultural refuse. The lip extension forms a ramp that assists in loading the agricultural refuse into the refuse container.

These together with additional objects, features and advantages of the garden debris receptacle with dustpan will be readily apparent to those of ordinary skill in the art upon reading the following detailed description of the presently preferred, but nonetheless illustrative, embodiments when taken in conjunction with the accompanying drawings.

In this respect, before explaining the current embodiments of the garden debris receptacle with dustpan in detail, it is to be understood that the garden debris receptacle with dustpan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the garden debris receptacle with dustpan.

It is therefore important that the claims be regarded as including such equivalent construction insofar as they do not depart from the spirit and scope of the garden debris receptacle with dustpan. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
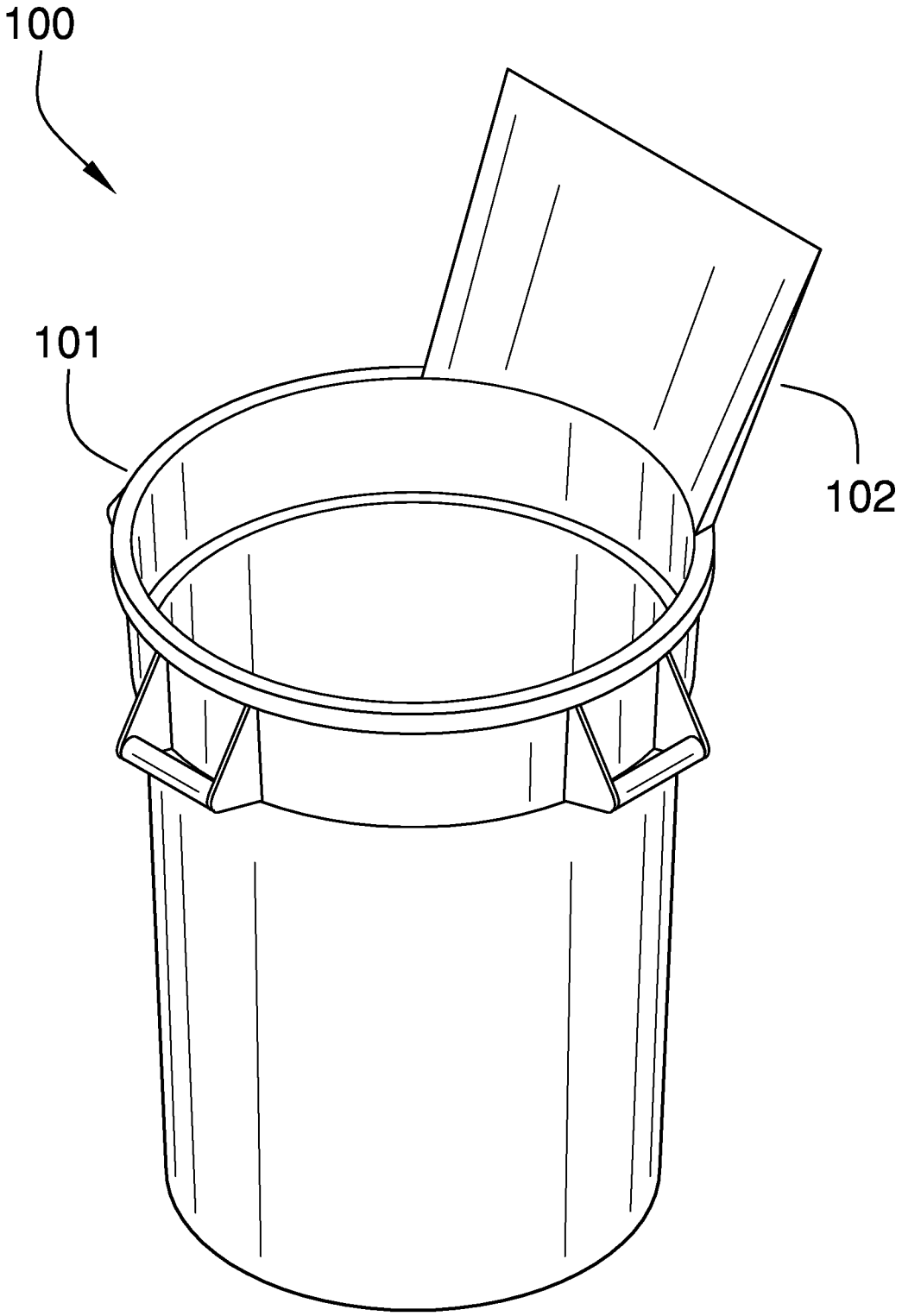
FIG. 1 is a perspective view of an embodiment of the disclosure.
Figure 3:
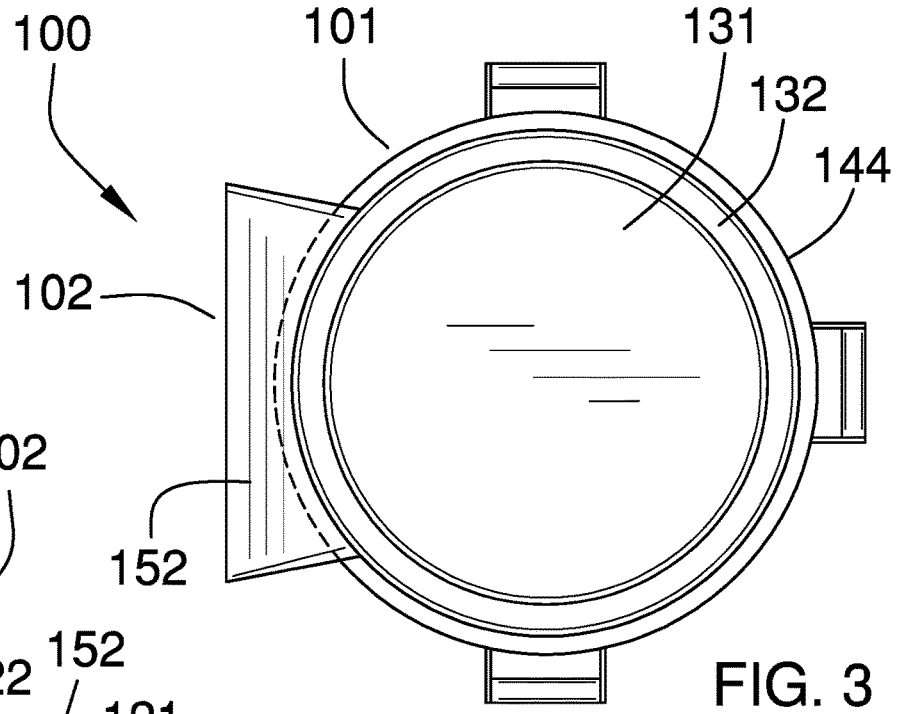
FIG. 3 is a side view of an embodiment of the disclosure.
Figure 2:
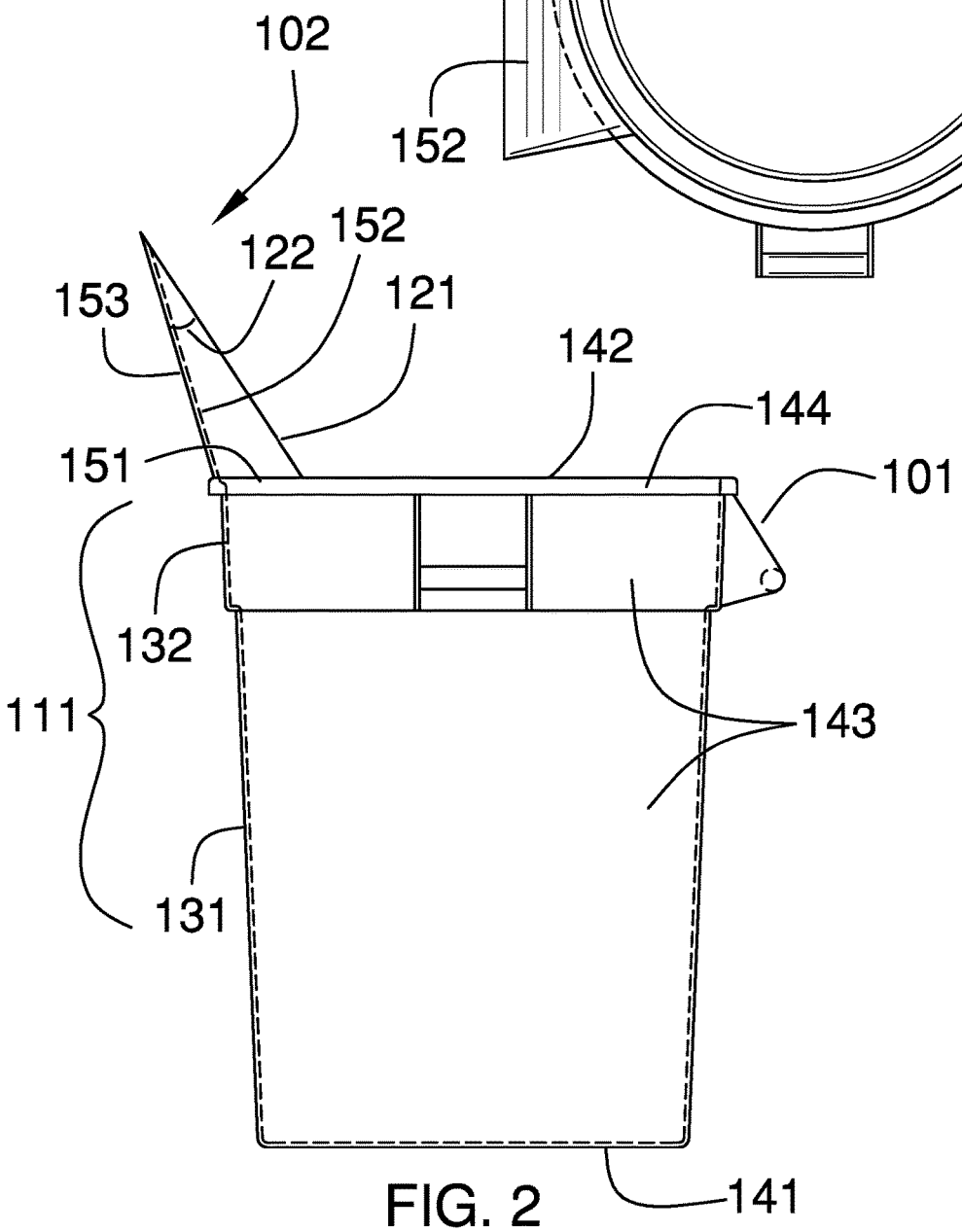
FIG. 2 is a top view of an embodiment of the disclosure.
Figure 4:
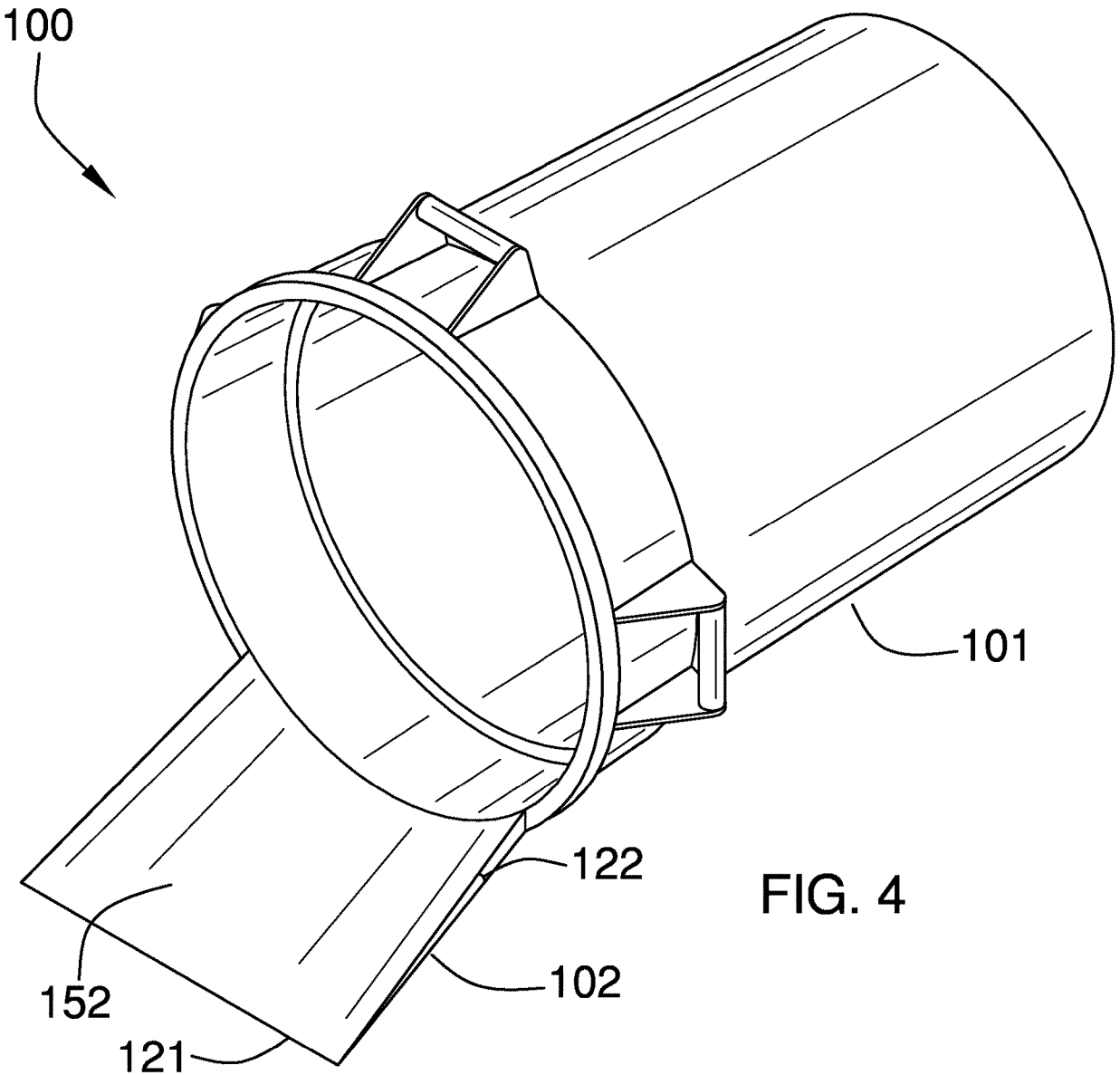
FIG. 4 is a perspective view of an embodiment of the disclosure.
Figure 5:
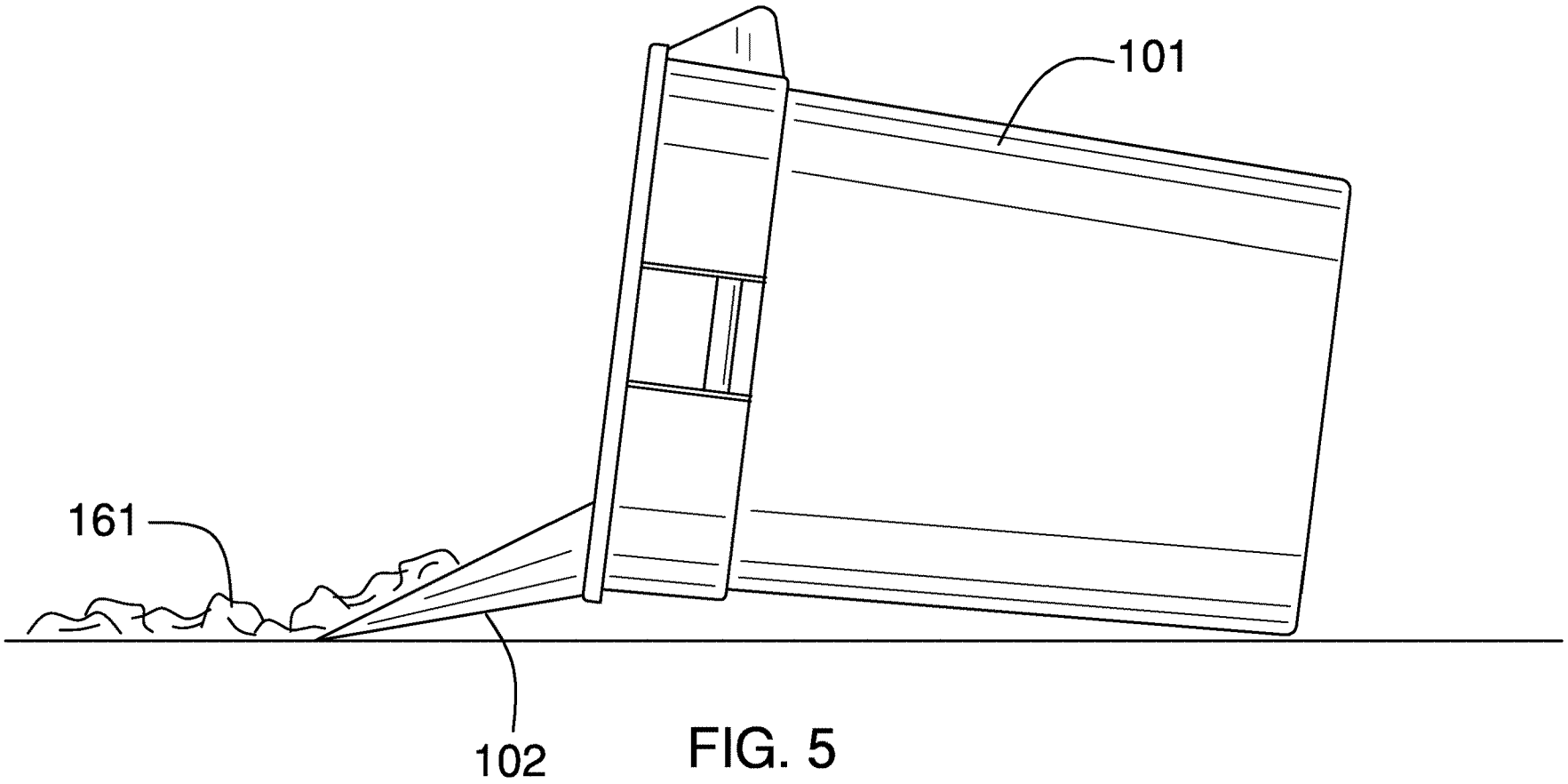
FIG. 5 is an in-use view of an embodiment of the disclosure.

Detailed reference will now be made to one or more potential embodiments of the disclosure, which are illustrated in FIGS. 1 through 5.

The garden debris receptacle with dustpan 100 (hereinafter invention) comprises a refuse container 101 and a lip extension 102. The lip extension 102 attaches to the refuse container 101. The invention 100 is configured for use with agricultural refuse 161. The lip extension 102 forms a ramp that assists in loading the agricultural refuse 161 into the refuse container 101. The agricultural refuse 161 refers to refuse created by horticultural activities.

The refuse container 101 is a containment vessel. The refuse container 101 is configured to receive agricultural refuse 161. The refuse container 101 is formed as a composite prism 111. The composite prism 111 further comprises a first prism 131, a second prism 132, and a rim 144. The composite prism 111 is a structure formed by the first prism 131 and the second prism 132. To form the composite prism 111, the first prism 131 attaches to the second prism 132 such that the center axis of the first prism 131 aligns with the center axis of the second prism 132. The composite prism 111 is further defined with a closed end 141, an open end 142, and a lateral face 143.

The first prism 131 is a cylindrical structure formed in the shape of a capped tube. The first prism 131 forms a portion of the containment structure of the refuse container 101. The second prism 132 is a cylindrical structure formed in the shape of a tube. The second prism 132 attaches to the open congruent face of the first prism 131 to form the composite prism 111 of the refuse container 101. The interior spaces of the first prism 131 and the second prism 132 combine to form the containment space of the refuse container 101.

The closed end 141 is the closed end of the capped tube structure formed by the composite prism 111. The closed end 141 is formed by the closed congruent face of the first prism 131. The open end 142 is the open congruent face of the capped tube structure is formed by the composite prism 111. The open end is formed from the open congruent face of the second prism 132 that is distal from the first prism 131.

The lateral face 143 comprises the surfaces of the composite prism 111 that are created by the concatenation of the individual non-congruent faces of the first prism 131 and the second prism 132. The lateral face 143 forms a surface structure that attaches the closed end 141 to the open end 142. The lateral face 143 forms the vertical walls of the containment structure formed by the composite prism 111 of the refuse container 101.

The rim 144 is a surface that is perpendicular to the center axis of the composite prism 111. The rim 144 forms the perimeter of the open end 142 of the composite prism 111. The rim 144 forms the surface on which the base lateral face 151 of the non-Euclidean wedge 121 attaches to attach the lip extension 102 to the refuse container 101.

The lip extension 102 is a ramp that attaches to the rim 144 of the open end 142 of the composite prism 111. The lip extension 102 forms a bridging surface. The lip extension 102 form a surface along which the agricultural refuse 161 is transported into the refuse container 101. The lip extension 102 is positioned such that the agricultural refuse 161 will slide over the rim 144 of the refuse container 101 as it enters into the refuse container 101. The lip extension 102 is a non-Euclidean structure that forms a concave surface that guides the agricultural refuse 161 into the refuse container 101. The concave surface of the lip extension 102 further guides the agricultural refuse 161 into the refuse container 101. The concave surface is called the concave lateral face 152. The lip extension 102 is formed as a non-Euclidean wedge 121.

The non-Euclidean wedge 121 is the structure of the lip extension 102 that forms the bridge used by the agricultural refuse 161 to clear the rim 144 as the agricultural refuse 161 enters the refuse container 101. The non-Euclidean wedge 121 has the shape of a non-Euclidean prism. The non-Euclidean wedge 121 is a modified triangular prism. The curvature of the center axis of the non-Euclidean wedge 121 follows a radius formed around a center point located on the center axis of the composite prism 111 that forms the refuse container 101. The non-Euclidean wedge 121 mounts on the rim 144 of the second prism 132. The non-Euclidean wedge 121 is further defined with a base lateral face 151, a concave lateral face 152, and a convex lateral face 153.

The base lateral face 151 is a rectangular surface that forms a portion of the non-congruent face of the non-Euclidean wedge 121. The base lateral face 151 is the surface of the non-congruent face of the non-Euclidean wedge 121 with the least surface area.

The convex lateral face 153 is a convex surface. The convex lateral face 153 is a rectangular surface that forms a portion of the non-congruent face of the non-Euclidean wedge 121. The convex lateral face 153 is the surface of the non-congruent face of the non-Euclidean wedge 121 with the greatest surface area.

The concave lateral face 152 is a concave surface. The concave lateral face 152 is a rectangular surface that forms a portion of the non-congruent face of the non-Euclidean wedge 121. The concave lateral face 152 is the remaining surface of the non-congruent face of the non-Euclidean wedge 121. The concave lateral face 152 forms the surface of the non-Euclidean wedge 121 over which the agricultural refuse 161 slides into the refuse container 101.

The non-Euclidean wedge 121 further comprises a wedge cant 122. The wedge cant 122 is the angle formed between the concave lateral face 152 and the convex lateral face 153 of the non-Euclidean wedge 121. The wedge cant 122 forms the slope of the ramp structure formed by the non-Euclidean wedge 121. The wedge cant 122 is a design parameter determined by the selection of the span of the length of the base lateral face 151 in the radial direction.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bridge: As used in this disclosure, a bridge refers to a surface used to transport one or more objects over an obstacle.

Cant: As used in this disclosure, a cant is an angular deviation from one or more reference lines (or planes) such as a vertical line (or plane) or a horizontal line (or plane).

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity. Always use supporting surface.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Non-Euclidean Prism: As used in this disclosure, a non-Euclidean prism is a prism structure wherein the center axis of the prism lies on a non-Euclidean plane.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Prismatic Section: As used in this disclosure, a prismatic section refers either one of the two objects formed by the bifurcation of a prism or pyramid by a plane that: 1) passes through the center axis of the prism or pyramid; and 2) does not perpendicularly intersect the center axis of the prism or pyramid. The angle of the prismatic section is the angle formed between the bifurcating plane and a line that is perpendicular to the center axis of the prism.

Ramp: As used in this disclosure, a ramp is an inclined surface that joins two surfaces that are: 1) of different elevations; or 2) not aligned on the same plane.

Radial: As used in this disclosure, the term radial refers to a direction that: 1) is perpendicular to an identified central axis; or, 2) projects away from a center point.

Rim: As used in this disclosure, a rim is an outer edge or border that follows along the perimeter of an object.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Truncated: As used in this disclosure, a geometric object is truncated when an apex, vertex, or end is cut off by a line or plane.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Wedge: As used in this disclosure, a wedge is a triangular prism structure. The wedge forms an inclined planar structure comprising an inferior face, a first vertical face, a second vertical face, and a third vertical face. The inferior face has a rectangular shape. The superior face has a rectangular shape. The superior face intersects the inferior face to form a wedge cant. The first vertical face and the second vertical face are triangular faces. The second vertical face is distal from the first vertical face. The third vertical face is a rectangular face that is distal from the line formed by the intersection of the inferior face and the superior face. The first vertical face, the second vertical face, and the third vertical face project perpendicularly away from the inferior face.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A refuse receptacle comprising:

a refuse container and a lip extension;

wherein the lip extension attaches to the refuse container;

wherein the refuse container is configured to receive agricultural refuse;

wherein the lip extension forms a ramp used to load the agricultural refuse into the refuse container;

wherein the lip extension is a non-Euclidean structure;

wherein the lip extension forms a concave surface that guides the agricultural refuse into the refuse container;

wherein the lip extension is formed as a non-Euclidean wedge;

wherein the non-Euclidean wedge is the structure of the lip extension that forms the bridge used by the agricultural refuse to clear the rim as the agricultural refuse enters the refuse container;

wherein the non-Euclidean wedge has the shape of a non-Euclidean prism;

wherein the non-Euclidean wedge is a modified triangular prism;

wherein the non-Euclidean wedge is further defined with a base lateral face, a concave lateral face, and a convex lateral face;

wherein the base lateral face is a rectangular surface that forms a portion of the non-congruent face of the non-Euclidean wedge;

wherein the base lateral face is the surface of the non-congruent face of the non-Euclidean wedge with the least surface area;

wherein the convex lateral face is a convex surface;

wherein the convex lateral face is a rectangular surface that forms a portion of the non-congruent face of the non-Euclidean wedge;

wherein the convex lateral face is the surface of the non-congruent face of the non-Euclidean wedge with the greatest surface area;

wherein the concave lateral face is a concave surface;

wherein the concave lateral face is a rectangular surface that forms a portion of the non-congruent face of the non-Euclidean wedge;

wherein the concave lateral face is the remaining surface of the non-congruent face of the non-Euclidean wedge;

wherein the concave surface is the concave lateral face.

2. The refuse receptacle according to claim 1 wherein the refuse container is a containment vessel;

wherein the refuse container is formed as a composite prism.

3. The refuse receptacle according to claim 2; wherein the lip extension forms a bridging surface;

wherein the lip extension form a surface along which the agricultural refuse is transported into the refuse container.

4. The refuse receptacle according to claim 3 wherein the composite prism further comprises a first prism, a second prism, and a rim;

wherein the composite prism is a structure formed by the first prism and the second prism;

wherein the first prism attaches to the second prism such that the center axis of the first prism aligns with the center axis of the second prism;

wherein the rim is formed on the second prism;

wherein the composite prism is further defined with a closed end, an open end, and a lateral face.

5. The refuse receptacle according to claim 4 wherein the first prism is a cylindrical structure formed in the shape of a capped tube;

wherein the second prism is a cylindrical structure formed in the shape of a tube;

wherein the second prism attaches to an open congruent face of the capped tube shape of the first prism to form the composite prism of the refuse container.

6. The refuse receptacle according to claim 5 wherein the interior spaces of the first prism and the second prism combine to form the containment space of the refuse container.

7. The refuse receptacle according to claim 6 wherein the closed end is the closed end of the capped tube structure formed by the composite prism;

wherein the closed end is formed by a closed congruent face of the first prism;

wherein the open end is the open face of the capped tube structure is formed by the composite prism;

wherein the open end is formed from the congruent face of the second prism that is distal from the first prism.

8. The refuse receptacle according to claim 7 wherein the lateral face comprises the surfaces of the composite prism that are created by the concatenation of the individual non-congruent faces of the first prism and the second prism;

wherein the lateral face forms a surface structure that attaches the closed end to the open end.

9. The refuse receptacle according to claim 8 wherein the rim is a surface that is perpendicular to the center axis of the composite prism;

wherein the rim forms the perimeter of the open end of the composite prism.

10. The refuse receptacle according to claim 9 wherein the lip extension attaches to the rim of the open end of the composite prism.

11. The refuse receptacle according to claim 10 wherein the lip extension is positioned such that the agricultural refuse will slide over the rim of the refuse container as it enters into the refuse container.

12. The refuse receptacle according to claim 11 wherein the curvature of the center axis of the non-Euclidean wedge follows a radius formed around a center point located on the center axis of the composite prism that forms the refuse container.

13. The refuse receptacle according to claim 12 wherein the non-Euclidean wedge mounts on the rim of the second prism.

14. The refuse receptacle according to claim 13 wherein the concave lateral face forms the surface of the non-Euclidean wedge over which the agricultural refuse slides into the refuse container.

15. The refuse receptacle according to claim 14 wherein the non-Euclidean wedge further comprises a wedge cant;

wherein the wedge cant is the angle formed between the concave lateral face and the convex lateral face of the non-Euclidean wedge.

16. The refuse receptacle according to claim 15 wherein the wedge cant is a function of by the selection of the span of the length in the radial direction of the base lateral face.

* * * * *